US006547580B1

(12) United States Patent
Leavitt et al.

(10) Patent No.: US 6,547,580 B1
(45) Date of Patent: Apr. 15, 2003

(54) SOCKET APPARATUS PARTICULARLY ADAPTED FOR LAND GRID ARRAY TYPE SEMICONDUCTOR DEVICES

(75) Inventors: Scott A. Leavitt, North Kingstown, RI (US); Andrew K. Houbre, New Bedford, MA (US); James A. Forster, Barrington, RI (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 09/961,658

(22) Filed: Sep. 24, 2001

(51) Int. Cl.[7] ..... H01R 11/22

(52) U.S. Cl. ..... 439/266; 439/487; 439/331; 439/73

(58) Field of Search ..... 439/266, 331, 439/73, 525, 487

(56) References Cited

U.S. PATENT DOCUMENTS 5,120,238 A * 6/1992 Marks et al. ..... 439/331
5,127,837 A * 7/1992 Shah et al. ..... 439/71
5,360,348 A * 11/1994 Johnson ..... 439/72
5,547,389 A * 8/1996 Hsu ..... 439/342
5,648,890 A * 7/1997 Loo et al. ..... 361/704
5,807,104 A 9/1998 Ikeya et al.
5,880,930 A * 3/1999 Wheaton ..... 361/690
6,033,235 A 3/2000 Ikeya
6,086,387 A * 7/2000 Gallagher et al. ..... 439/71
6,142,809 A * 11/2000 Fukunaga ..... 439/331
6,155,859 A * 12/2000 Choy ..... 439/331
6,354,859 B1 * 3/2002 Barabi et al. ..... 439/331
6,442,026 B2 * 8/2002 Yamaoka ..... 361/704

* cited by examiner

*Primary Examiner*—Lynn D. Feild
*Assistant Examiner*—Hae Moon Hyeon
(74) *Attorney, Agent, or Firm*—Russell E. Baumann; Frederick J. Telecky, Jr.

(57) ABSTRACT

A socket (10) has a cover (14) pivotably mounted to a base (12). The base is formed with a seat (12*a*) for mounting a semiconductor device on a contact mounting plate (18). A locking mechanism (20) for locking the cover in the closed position includes an over center linkage mechanism interacting with a locking pin (20*a*). In a modified embodiment, the locking mechanism is provided with a pivotable locking member (27) to provide either manual or automated operation. The cover (14) of socket (10) also comprises an integrally formed heat sink. In another embodiment (10'), a separate heat sink (30) is independently mounted on the cover (28) provided with an aperture through the cover in which the heat sink is slidably mounted.

17 Claims, 14 Drawing Sheets

SOCKET APPARATUS PARTICULARLY ADAPTED FOR LAND GRID ARRAY TYPE SEMICONDUCTOR DEVICES

RELATED APPLICATION

This application contains subject matter also disclosed in copending, coassigned application Ser. No. 09/961,659 filed of even date herewith.

FIELD OF THE INVENTION

This invention relates generally to a socket used in conducting electrical tests of semiconductor (SC) devices and more particularly to a socket for removably receiving a semiconductor device, such as an integrated circuit, and making electrical contact between the contacts of the device and respective contacts or terminals of the socket which in turn are connected to respective contact pads of a circuit substrate.

BACKGROUND OF THE INVENTION

It is conventional to place a semiconductor device in a socket which, in turn, is connected to a circuit substrate and then to place the substrate into an oven so that the temperature and voltage of the semiconductor device can be raised to a selected level to conduct a stress test, called a burn-in test, to determine whether the semiconductor device meets the required manufacturing specifications.

Typically, prior art sockets used for this purpose comprise a base member formed of electrically insulative material in which an electrical contact element is mounted for each contact of the semiconductor device to be tested. The contact elements are arranged in a selected pattern relative to the semiconductor device mounting seat provided in the base and have contact portions adapted to be placed in electrical engagement with respective contacts of the semiconductor device. In one type of prior art socket the semiconductor device to be tested is placed in the semiconductor device receiving seat and a cover member, pivotably mounted to the base, is held in a closed position by means of a spring biased latch, a clip, a nubbin on an actuation arm or base, a protrusion or the like. The cover places a bias on the semiconductor device to provide a selected contact force between the device leads and the contact elements of the socket. When a semiconductor device is loaded into the socket for testing it is critical that the cover be maintained in the closed position for the duration of the test procedure, however, in typical prior art structures either the cover locking mechanism is cumbersome and time consuming to apply, such as a clip, or it is subject to accidental dislodgement with consequent unintended and untimely opening. Another problem associated with this type of socket having a pivotably mounted cover relates to the angled application of force to the semiconductor device sometimes causing damage to the semiconductor device. That is, due to the pivoting movement of the cover, typically the upper inside edge of the semiconductor device closest to the pivotable connection of the cover to the base is the first portion of the device to engage the cover and it receives a force the direction of which changes as the cover is pivoted until the bottom surface of the cover comes into a parallel position with the top surface of the semiconductor device. This angled force, i.e., force which is not normal to the top of the SC, can damage the SC device.

SUMMARY OF THE INVENTION

It is an object of the present invention to provide a socket which overcomes the above noted limitations of the prior art.

Another object of the invention is to provide a socket having a pivotably mounted cover which has a locking mechanism for maintaining the cover in the closed position which is simply and quickly locked and unlocked and yet which is not subject to accidental or unintended unlocking. Another object of the invention is the provision of a socket having a pivotably mounted cover which avoids damaging semiconductor devices loaded therein. It is a further object of the invention to provide a socket which is highly reliable in operation and economical to manufacture.

Briefly, a socket made in accordance with a first embodiment of the invention comprises a cover pivotably mounted to a base to enclose a semiconductor device removably received for testing purposes. A locking mechanism for maintaining the cover in the closed position during the testing procedure includes a locking pin extending laterally from the base which interacts with an over center linkage mechanism. The linkage mechanism includes a first handle link pivotably mounted on the cover, providing a first axis immovable relative to the cover, a second locking link rotatably mounted to the cover having a locking pin receiving catch at one end thereof and having another end pivotably connected to an end of a third interconnecting link providing a second axis movable relative to the cover and with another end of the third link pivotably connected to the first link providing a third axis movable relative to the cover. When the cover is pivoted toward the closed position with the handle of the first link extending away from the cover, the first link is pivoted toward the cover bringing the locking pin receiving catch into engagement with the locking pin and the end of the cover frame into engagement with the locking pin bar and continued pivotal motion results in the third movable axis moving with snap action from one side of an imaginary line extending between the first and second axes to the other side thereof to thereby securely lock the cover in the closed position. Over center movement is limited by engagement of the second locking link with the first handle link. In a modified embodiment, the locking pin is attached to the second locking link and a locking catch member is pivotably mounted on the base for interaction with the locking pin. In this embodiment the cover can be opened either by raising (pivoting) the first handle link for manual operation or by applying a force to the pivotably mounted locking catch member.

In one embodiment the cover is integrally formed with a heat sink while in another embodiment a separately formed heat sink is independently mounted on the cover for sliding movement through a heat sink receiving aperture formed in the cover. According to a feature of the latter embodiment, the heat sink is preferably mounted on the cover with a first spring connection adjacent the hinged end of the cover and with second and third spring connections on the opposite end of the cover to ameliorate an even application of force to a semiconductor device disposed in the semiconductor receiving seat of the base. According to another feature of an embodiment of the invention, a boss having an outer configuration generally matching but preferably slightly less than that of a die of a semiconductor device to be received in the socket extends downwardly from the heat sink for engagement with a semiconductor device received in the socket. According to yet another feature, one or more pressure bars are slidably mounted for flexible movement in a pair of slots in the bottom surface of the cover for engaging the outer portions of the semiconductor device received in the socket.

In a modified embodiment the bottom surface of the heat sink is provided with a recessed portion for use with semiconductor devices having packaging features which extend above the die portion(s) and/or to move the initial engagement of the heat sink with the semiconductor device to a location slightly inboard of the outer periphery of the SC die.

BRIEF DESCRIPTION OF THE DRAWINGS

Other objects, advantages and details of the socket of the invention appear in the following detailed description of preferred embodiments of the invention, the detailed description referring to the drawings in which common reference characters are used to designate the same parts throughout the drawings and in which.

DETAILED DESCRIPTION OF THE PREFERRED EMBODIMENTS

Figure 1:
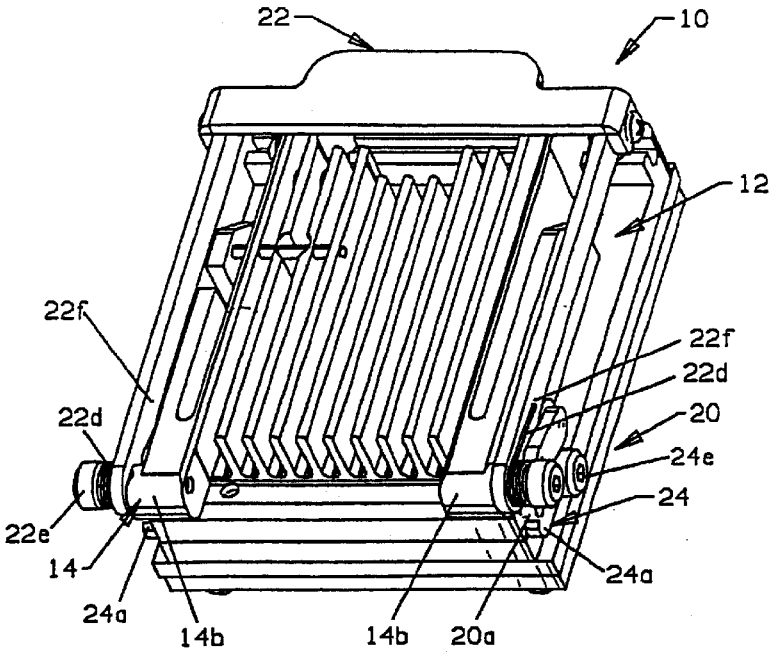
FIG. 1 is a perspective view of a socket made in accordance with a first embodiment of the invention in the closed position.
Figure 2:
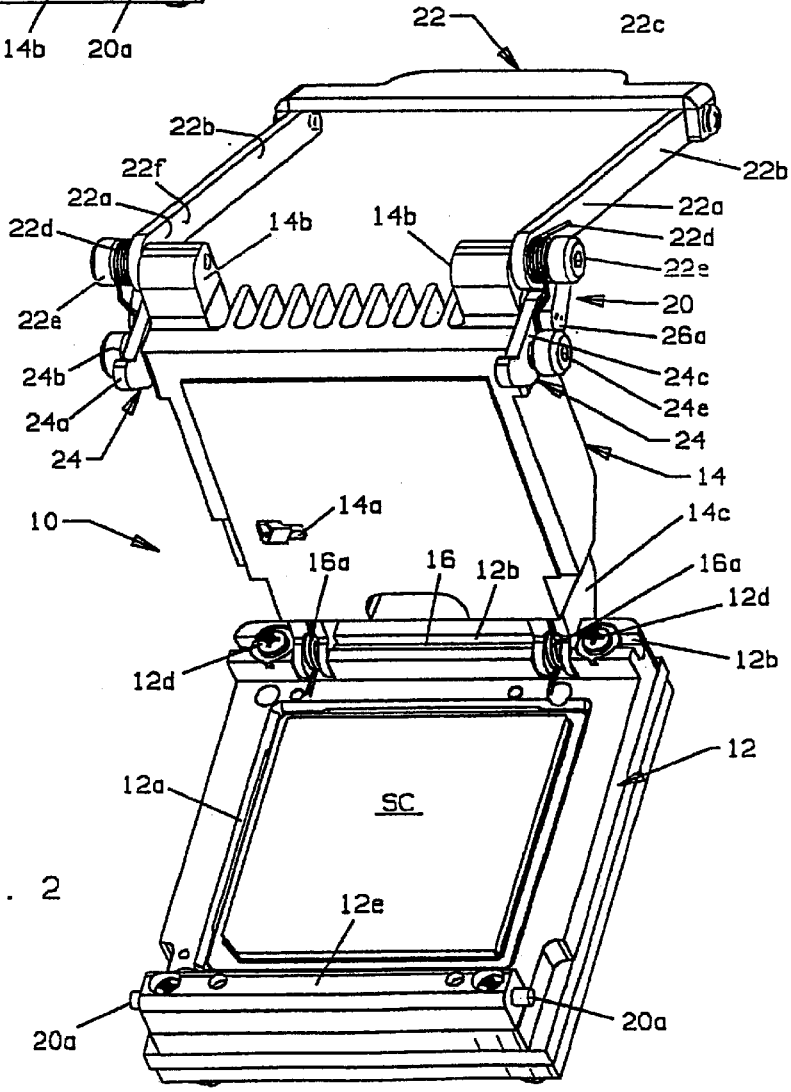
FIG. 2 is a perspective view of the FIG. 1 socket in the opened position.
Figure 3:
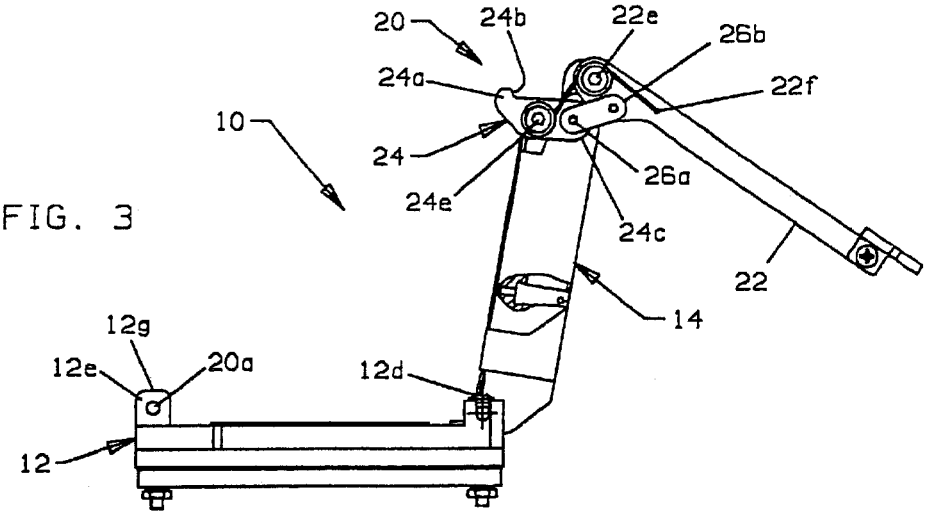
FIG. 3 is a side elevational view, partly broken away, of the FIG. 2 (opened position) socket.
Figure 4:
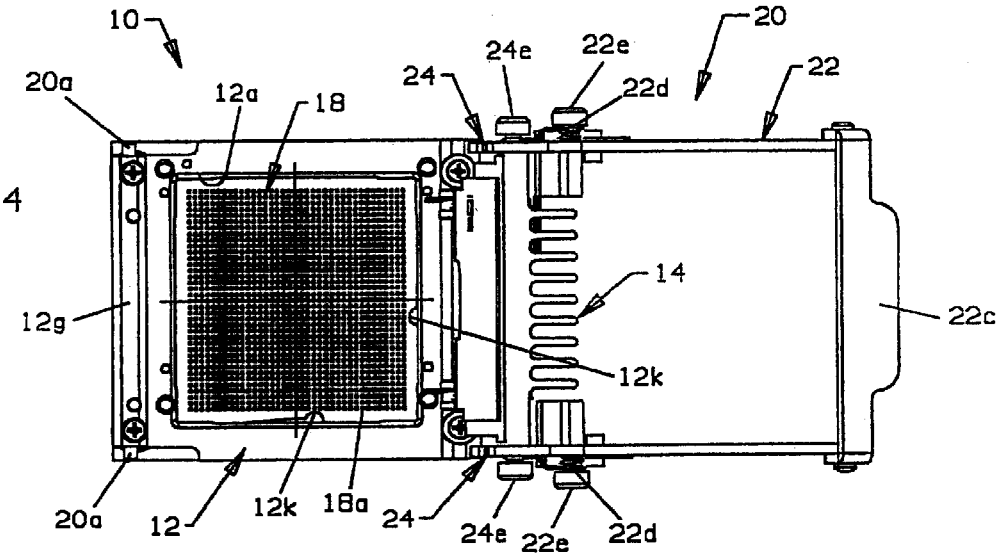
FIG. 4 is a top view of the FIG. 2 socket.
Figure 5:
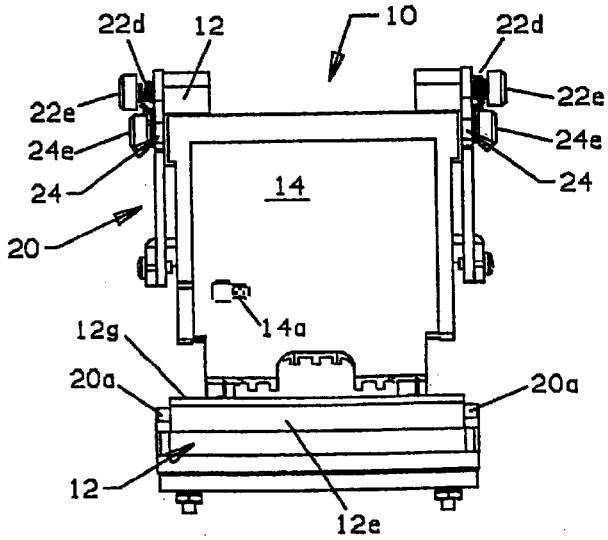
FIG. 5 is a front elevational view of the FIG. 2 socket.
Figure 6:
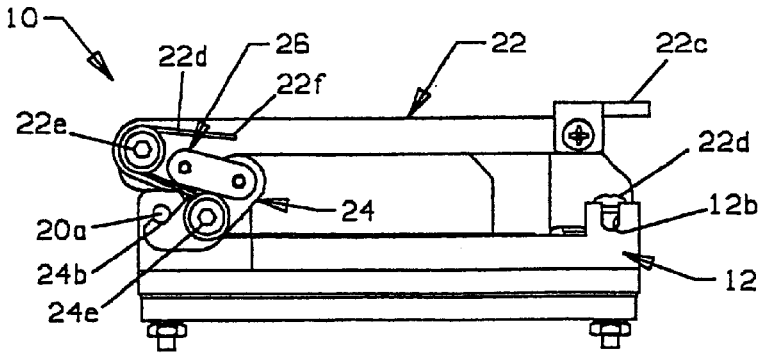
FIG. 6 is a side elevational view of the FIG. 1 (closed position) socket.
Figure 7:
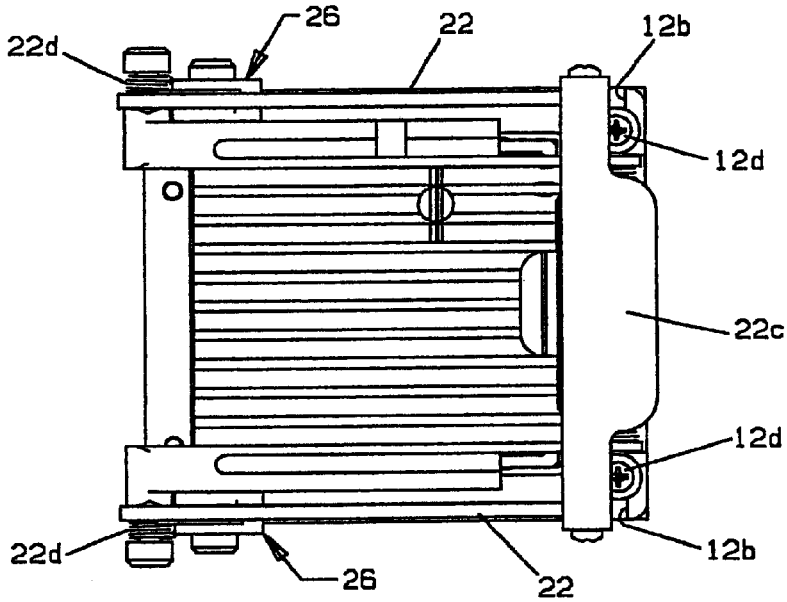
FIG. 7 is a top view of the FIG. 6 socket.
Figure 8:
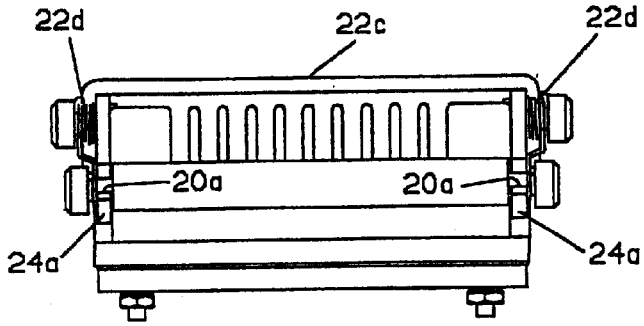
FIG. 8 is a front elevational view of the FIG. 6 socket.

A first preferred embodiment of the invention will be described with reference to FIGS. 1–9. Socket 10 made in accordance with the invention comprises a base 12 with an integral cover and heat sink 14 pivotably mounted at a first end to the base through shaft 16 (FIG. 2) disposed in slot 12*b* and locked therein by a suitable retainer such as washers 12*f* retained by the head of screws 12*d*. Base 12 is formed with a semiconductor device seat 12*a* exposing a contact mounting plate 18 having a selected array of contacts 18*a* (FIG. 4). Seat 12*a* is configured to be complimentary in shape with a selected semiconductor device SC (FIG. 2) so that device SC to be tested received in seat 12*a* will have its contacts on its lower surface (not shown) aligned and in engagement with respective contacts 18*a*. Spring members 12*k* (FIG. 4) can be provided to bias a device SC received in seat 12*a* toward a known reference location. A temperature sensor, such as a thermocouple or the like, may be mounted in an aperture 14*a* of cover 14, if desired, to monitor the temperature of the semiconductor device during the test procedure.

Socket 10 includes a locking mechanism 20 having a first portion of a locking member in the form of a locking pin 20*a* extending laterally outwardly from each side of a locking bar 12*e* mounted on base 12 at the second end thereof opposite to the first end and essentially serving as part of the base and a linkage mechanism preferably provided on each side of cover 14 at the second end comprising a handle or first link 22 which is generally U-shaped with the free distal ends 22*a* serving as a first end of link 22. Ends 22*a* are pivotably connected to cover 14 by screws 22*e* at opposite sides thereof at hubs 14*b* forming a first axis 1 (see FIG. 9) which is immovable relative to cover 14. The second ends 22*b* of the first link are interconnected by handle or bight portion 22*c*. The second ends 22*b* are movable toward and away from cover 14 between closed and opened positions, respectively and are biased toward the opened position by a suitable spring 22*d* received on screws 22*e* and having an end received in hole 22*f* of first link 22 and another end (not shown) trained around screw 24*e*.

A locking or second link 24 is rotatably mounted at screw 24*e* to each side of cover 14 at a point intermediate to first and second ends with the first end 24*a* having a second portion of a locking member in the form of a locking pin receiving catch 24*b*.

Figure 9:
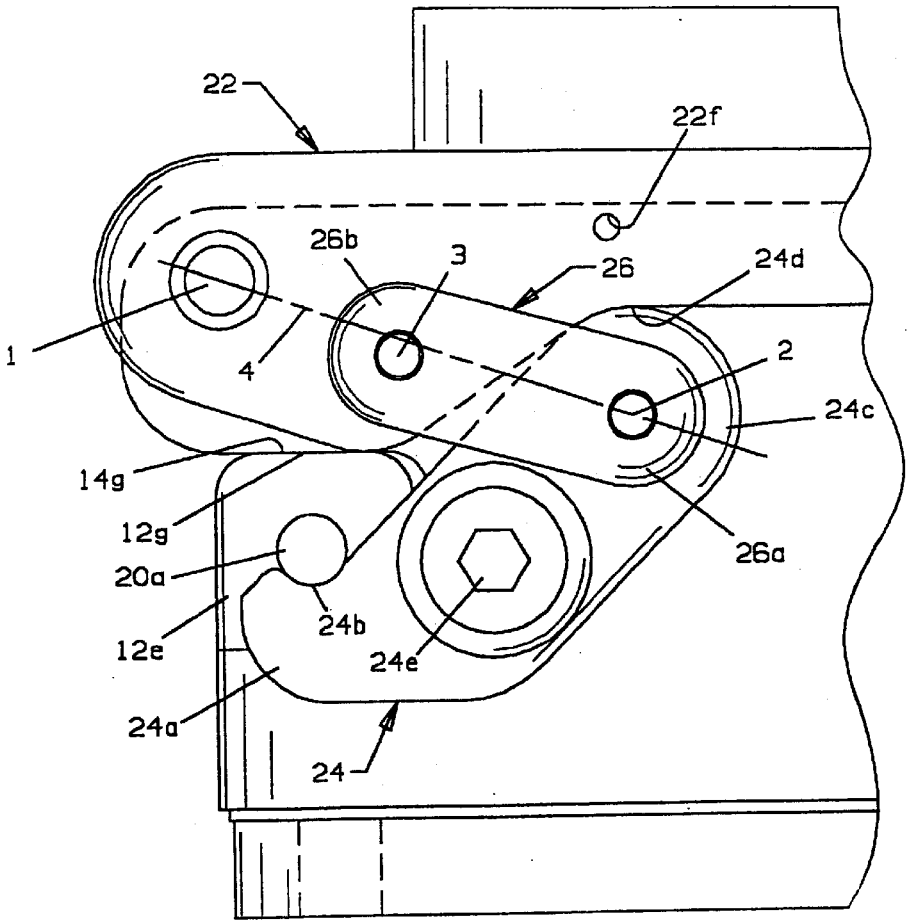
FIG. 9 is an enlarged, simplified portion of the FIG. 6 socket showing the linkage mechanism used in locking the socket in the closed position.

An interconnecting or third link 26 for each linkage side having first and second ends 26*a*, 26*b*, respectively, has its first end 26*a* pivotably connected to the second end 24*c* of second locking link 24 forming a second axis 2 (FIG. 9) movable relative to cover 14 and its second end 26*b* pivotably connected to the first handle link at a third axis 3 (FIG. 9) movable relative to cover 14. With particular reference to FIG. 9, the third axis 3 is disposed in a position on one side of an imaginary line 4 drawn between axes 1 and 2 when the handle or second end of link 22 is in a position away from the cover maintaining the locking pin receiving catch 24*b* out of alignment with the locking pin 20*a*. The locking mechanism is actuated by pivoting cover 14 toward the closed position while maintaining the second end of link 22 in a position away from the cover thereby allowing the locking pin receiving catch to pass by locking pin 20*a*. The second end of link 22 is then pivoted toward the cover and the locking pin receiving catch comes into engagement with locking pin 20*a* and surface 14*g* of cover 14 engages surface 12*g* of locking bar 12*e* and with the third axis 3 snapping over to the other side of imaginary line 4. It should be noted that in order for the over center position of axis 3 to be stable, the distance between the surface of the catch which engages the locking pin 20*a* and surface 14*g* of the cover which engages top surface 12*g* is less than the bottom of locking pin 20*a* and the top surface 12*g* of the locking bar mounted on the base with cover 14 tightly biased against locking bar 12*e*. Continued movement of second locking link 24 and third axis 3 is limited by engagement of surface 24*d* of second end 24*c* of locking link 24 with handle link 22 as seen in FIG. 9.

In the locked position described above, the cover is securely maintained in that position, insensitive to vibration, until the second end of first handle link 22 is pivoted away from the cover.

In the embodiment described above, the cover also serves as an integrally formed heat sink to conduct heat away from the semiconductor device being tested in order to prevent excessive heating thereof. In the FIGS. 10–20 modified embodiments, a heat sink member is shown movably mounted on the cover so that the force used in obtaining the required contact force for the many individual contact matings between the contact elements in the contact mounting plate and respective contacts or leads of the semiconductor device can be separated from the force used to provide a thermal coupling between the heat sink and the semiconductor device being tested and can be independently controlled.

Figure 10:
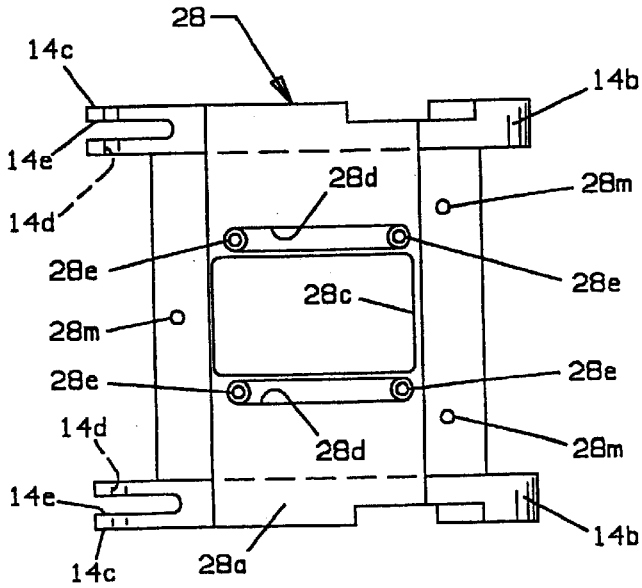
FIG. 10 is a bottom plan view of the cover of another embodiment of the invention.
Figure 10A:
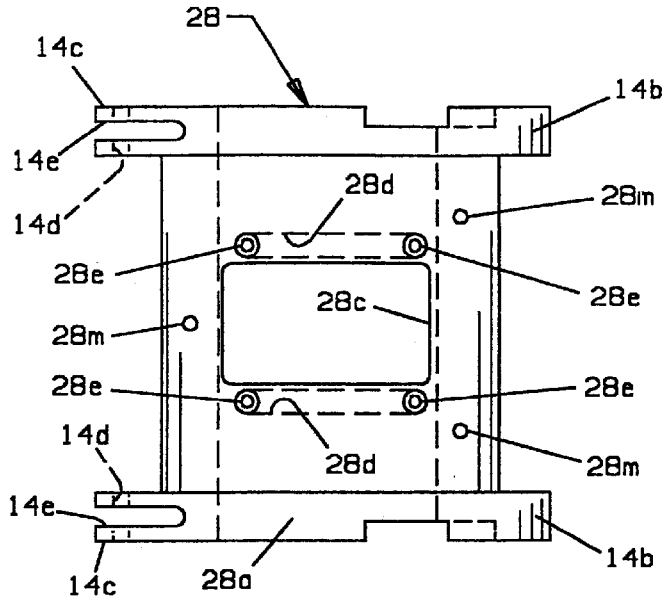
FIG. 10*a* is a top plan view thereof.
Figure 10B:
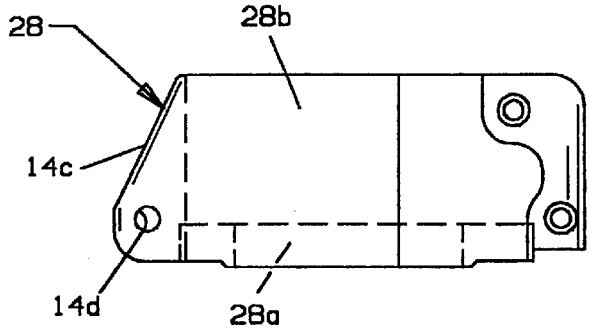
FIG. 10*b* is a side elevational view thereof and FIG. 10*c* is a front elevational view, partly in cross section, thereof.
Figure 10C:
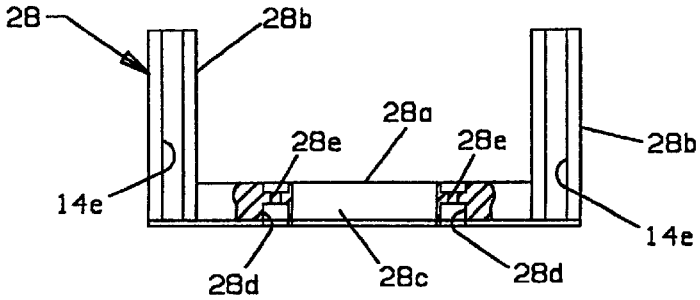

With reference to FIGS. 10–10*c*, cover 28 comprises a bottom wall 28*a* and opposed upstanding sidewalls 28*b*. Hub 14*b* is formed at one end of each sidewall for mounting of link 22 and, at the opposite end of each sidewall, ears 14*c* are provided for pivotal mounting to shaft 16, described with reference to FIG. 2. Ears 14*c* are provided with a laterally extending bore 14*d* for receipt of shaft 16. Ears 14*c* are preferably bifurcated at 14*e* to enhance stability of the mounting of the cover to the base. Springs 16*a* are conveniently placed about shaft 16 between the bifurcated ears and are used to bias cover 28 (and 14 of the first embodiment) toward the open position. A heat sink receiving aperture 28*c* is centrally located in bottom wall 28*a* for slidably receiving therethrough a stepped portion of heat sink 30 to be discussed.

Figure 11:
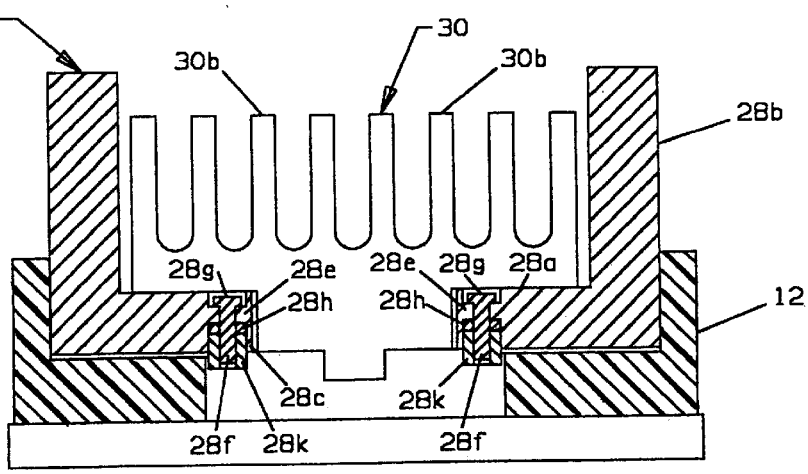
FIG. 11 is a simplified cross sectional view showing the FIG. 10 cover with a separate heat sink and details of pressure bars on either side of the heat sink.

Parallel extending slots 28*d* are formed in the bottom surface of bottom wall 28*a* on either side of aperture 28*c* closely adjacent thereto and extending in a direction generally parallel to sidewalls 28*b*. As seen in FIGS. 10*c* and 11, countersunk bores 28*e* extend through bottom wall 28*a* at each end of slots 28*d*. A pin 28*f* having a head 28*g* is received in each bore 28*e* with the head disposed in the countersunk portion recessed from the top surface of wall 28*a*. Pins 28*f* are received through a respective hole in flexible strip 28*h* of suitable material such as silicone rubber having a selected durometer to provide a compressable mount and the end of the pins are fixedly attached to a pressure bar 28*k* slidably received in each slot 28*d*, the pressure bars extending beyond the lower surface of bottom wall 28*a* and being adapted to place a flexible clamping force on the outer margins of a semiconductor device received in the semiconductor device seat of the base. Although two such pressure bars are described, it is within the purview of the invention to use a single pressure bar or more than two pressure bars, if desired. Further, other compressible elements can be employed in place of flexible strip 28*h* such as a spring element, if desired.

Figure 12:
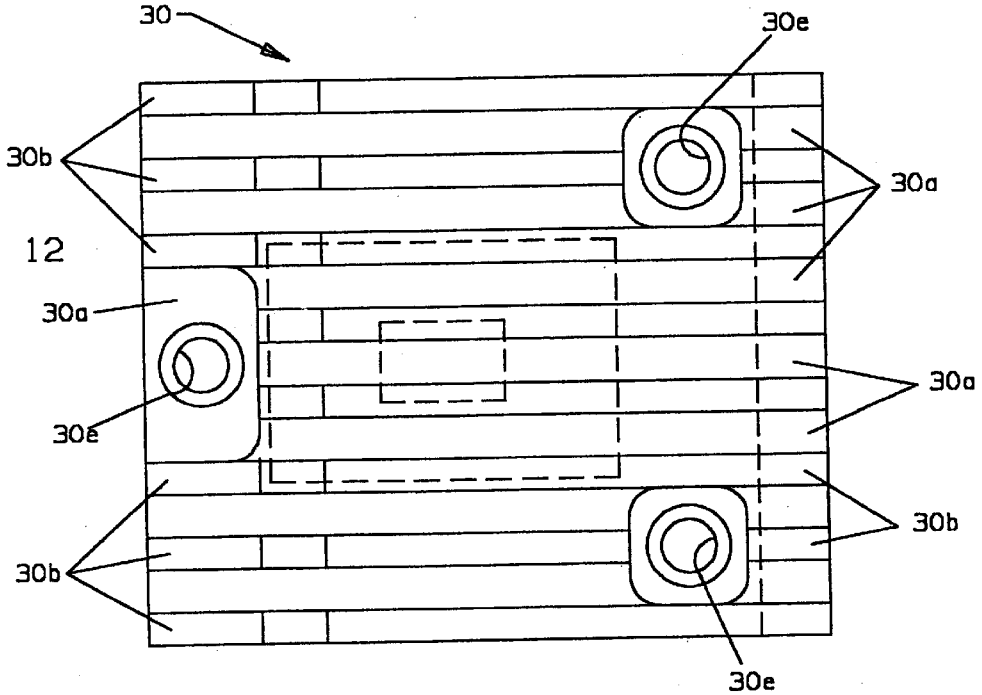
FIG. 12 is a top plan view of the heat sink of FIG. 11
Figure 12A:
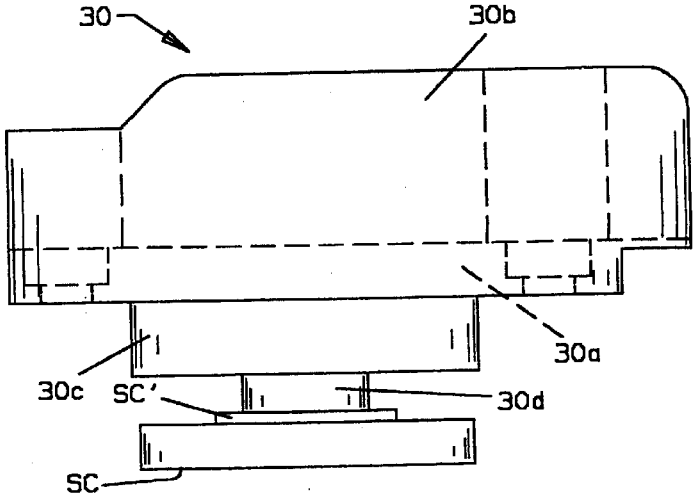
FIG. 12*a* is a side elevational view thereof.
Figure 13:
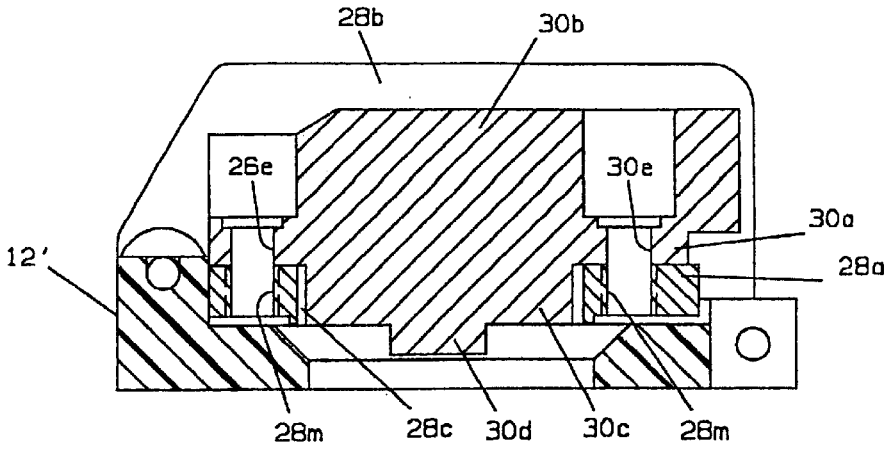
FIG. 13 is a simplified cross sectional view showing details of the mounting arrangement of the FIG. 12 heat sink on the cover.
Figure 14:
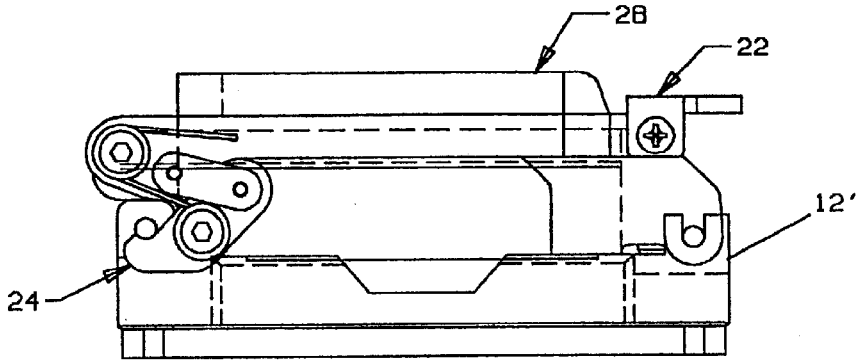
FIG. 14 is a side elevational view of another embodiment of the invention incorporating a modified heat sink movably mounted on the cover of the socket.
Figure 15:
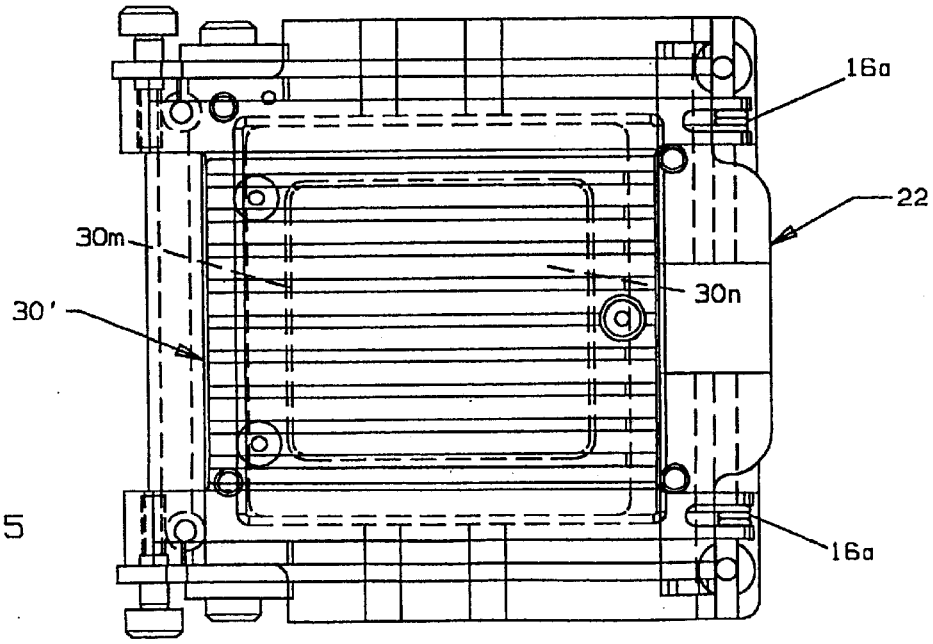
FIG. 15 is a top view of the FIG. 14 socket.
Figure 16:
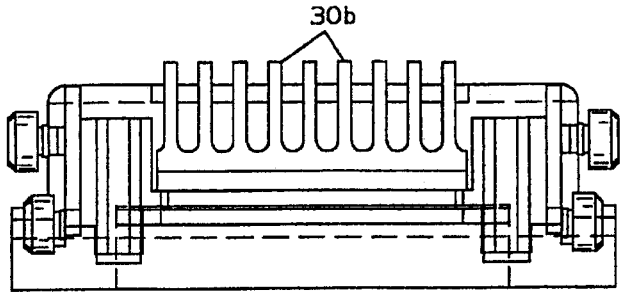
FIG. 16 is a front elevational view of the FIG. 14 socket.
Figure 18:
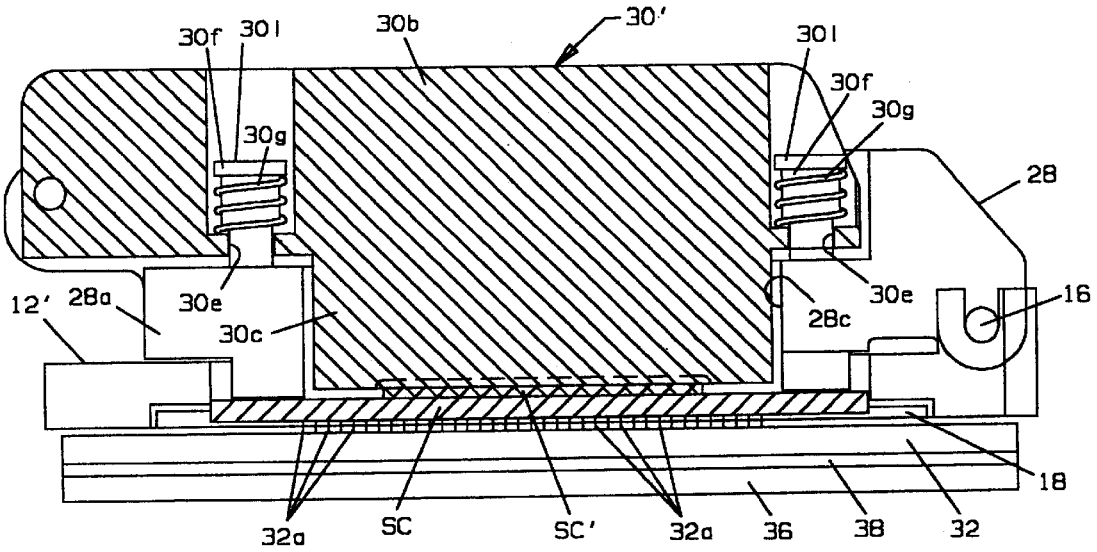
FIG. 18 is a simplified cross sectional view similar to FIG. 13 of the modified heat sink and showing details of the mounting arrangement of both heat sink embodiments on the cover and also showing the socket mounted on a circuit board.

FIGS. 12 and 12*a* show one type of heat sink adapted for use with cover 28. Heat sink 30 comprises a bottom wall 30*a* and upstanding spaced-apart heat transfer fins 30*b*. A stepped portion 30*c*, complimentary in shape with aperture 28*c*, extends downwardly from bottom wall 30*a* and boss portion 30*d*, complimentary in shape with the die portion SC' of a semiconductor device SC to be placed in the semiconductor device seat of the base but slightly smaller in length and width, extends further downwardly from stepped portion 30*c*. Fins 30*b* are cut back from mounting bores 30*e*. With reference to FIGS. 12, 13 and 18, heat sink 30 is received on cover 28 with stepped portion 30*c* received through apertures 28*c*. Mounting bores 30*e* are aligned with threaded bores 28*m*. A threaded member 30*f* is received in each mounting aperture and threaded into a respective threaded bore 28*m* with the head 30*l* of each threaded member 30*f* spaced a selected amount from a spring seat on bottom wall 28*a* and a coil spring 30*g* is disposed between each head 30*l* and the head sink 30. The coil spring is selected to provide the desired force to be applied to the semiconductor device through boss 30*d* (FIG. 12) or the lower surface of heat sink 30' of FIG. 18, to be discussed. Preferably, and as shown, three mounting bores 30*e* are used in mounting the heat sink to the cover with two bores 30*e* being disposed adjacent the end of the cover which swings open and spaced apart, for example, somewhat more than the width of aperture 28*c*, and the third bore 30*e* being centrally disposed adjacent to the pivoted mounted end of the cover. In this way, the application of even force to the semiconductor device is ameliorated to provide a suitable heat conductive coupling without exerting excessive force.

Figure 17:
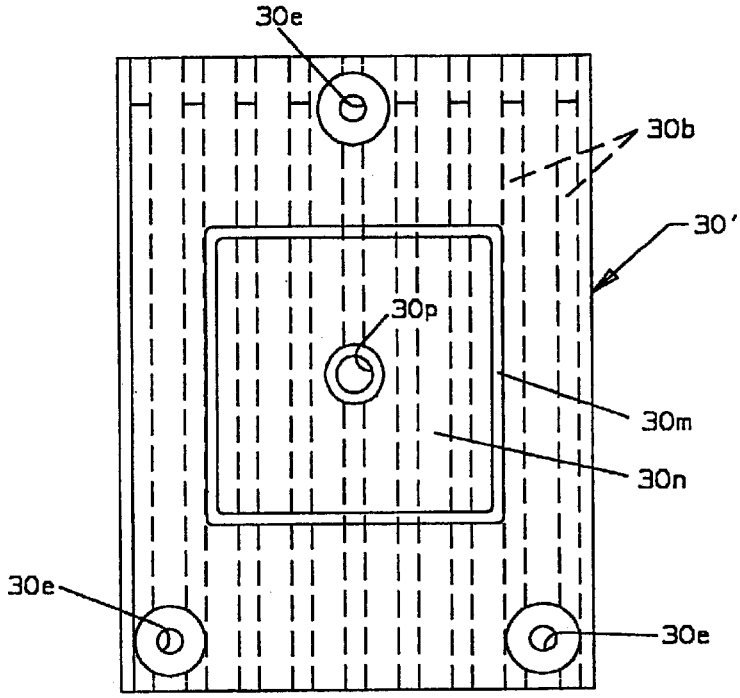
FIG. 17 is a bottom plan view of a modified heat sink for the FIG. 14 socket and FIG. 17*a* is a front elevational view, partly in cross section, thereof.
Figure 17A:
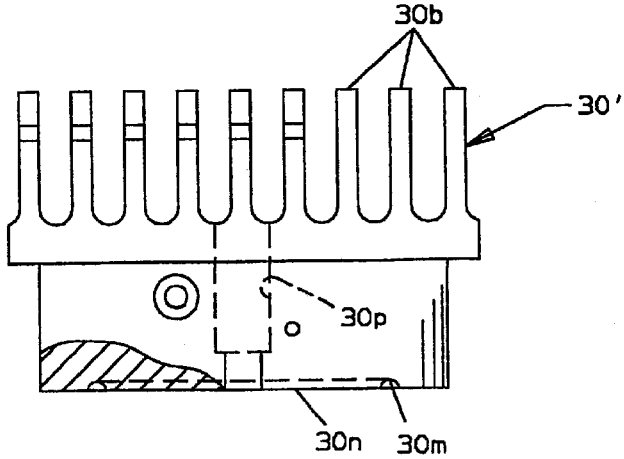

The socket shown in FIGS. 14–18 is shown with a heat sink modified to accommodate certain flip chip, non-encapsulated semiconductor packages when the backside of the die is contacted directly by the heat sink. That is, the inner surface of the heat sink member which engages the semiconductor package is recessed at 30*m* and provided with a flat central portion 30*n* to accommodate a selected profile. Also shown in FIGS. 17, 17*a* is an optional bore 30*p* to provide access, if desired, for a temperature sensor.

FIG. 18 also shows a socket made in accordance with the invention as it would be used mounted on a circuit board 32 having an array of contacts 32*a* interconnected to the matching array of contacts of the contact mounting plate. Preferably, a back-up plate 36 and insulator 38 are attached to the socket through the circuit board to maintain rigid support and prevent bowing of the circuit board. Suitable machine screws are received through the base of the socket, the circuit board, insulator and back-up plate with nut to fasten the several components together and provide desired contact force between the socket and circuit board. Typically, a circuit board will have many sockets mounted on the board for placement in an oven and simultaneous testing.

Figure 19:
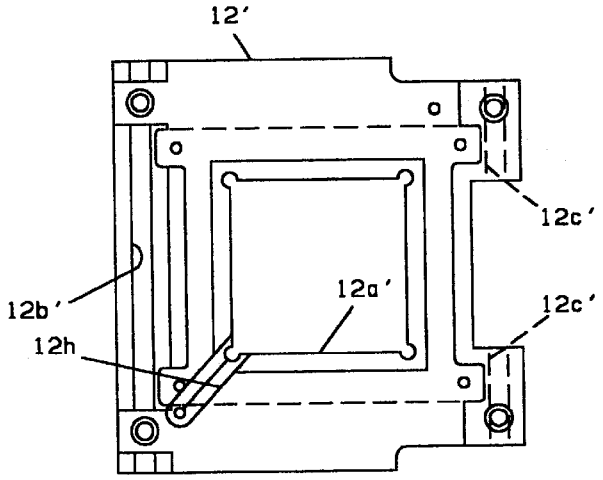
FIG. 19 is a top plan view of the base of another embodiment of the socket shown in FIG. 20
Figure 19A:
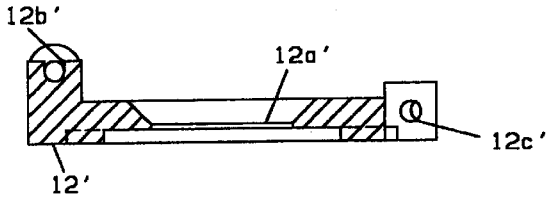
FIG. 19*a* is a cross sectional view taken through FIG. 19.
Figure 20:
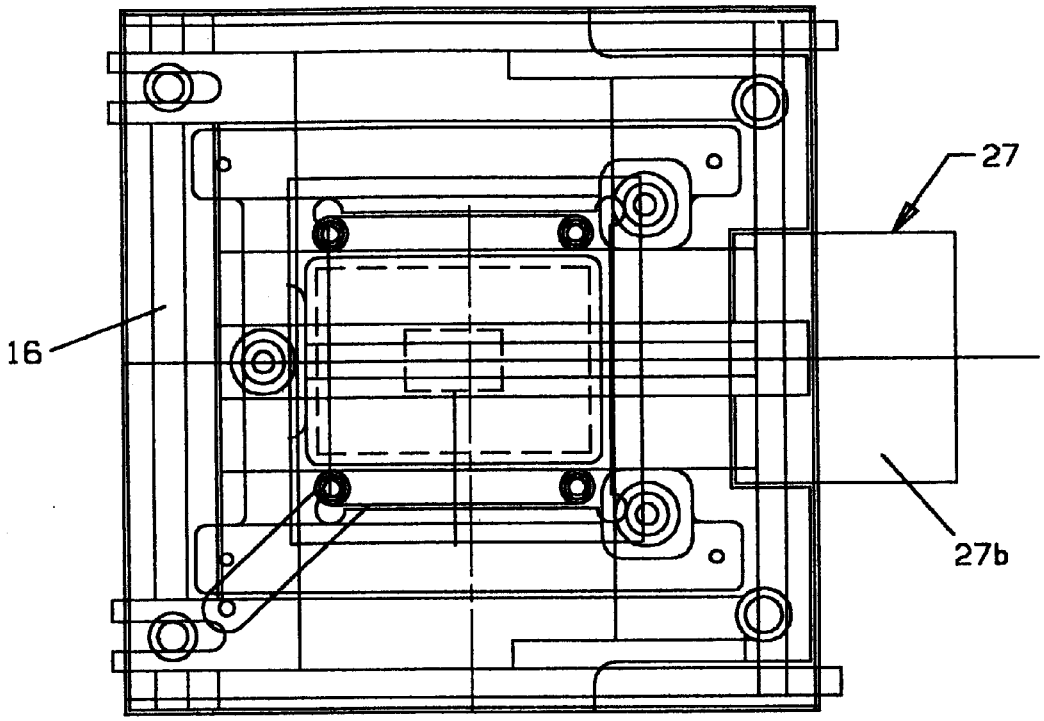
FIGS. 20 and 21 are a top plan view and a side elevational view, respectively, of another embodiment of the invention showing a modified locking mechanism.
Figure 21:
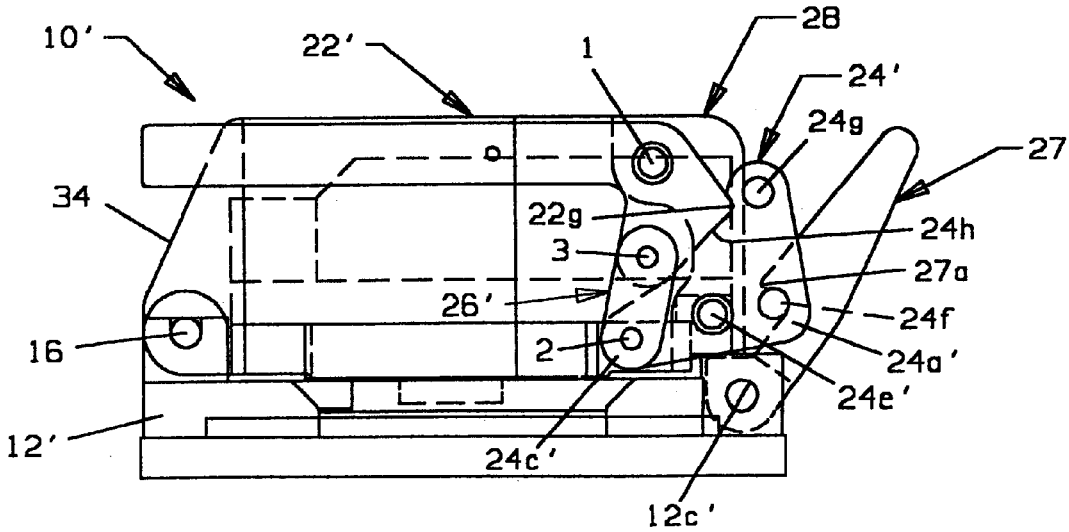

With reference to FIGS. 19–23, another embodiment is shown which relates to a locking and linkage mechanism used for either automatic or manual operation. FIGS. 19, 19*a* show a base 12' formed with a semiconductor device seat 12*a*' having a slightly different configuration from that shown in FIG. 1. A slot 12*b*' is formed along one end for receipt of shaft 16 for pivotably connecting the cover and bores 12*c*' are formed at the opposite end for receipt of a locking member, to be described. Also shown in FIG. 19 is a slot 12*h* which is open to seat 12*a*' for placement of a suitable spring member (not shown) for biasing an SC device toward a reference surface, much like springs 12*k* shown in FIG. 4. As shown in FIG. 21, first link 22'; is pivotably connected to cover 34 as in the FIGS. 1–9 embodiment. Second locking link 24' is rotatably connected to the cover at a location 24*e*' intermediate first and second ends 24*a*', 24*c*'. A second locking member portion in the form of a pin 24*f* extends laterally between the second links disposed at each side of socket 10'. The second end 24*c*' is pivotably connected to third interconnecting link 26' as in the FIGS. 1–9 embodiment. Third interconnecting link 26' is pivotably connected at one end to second link 24' and at its other end to first handle link 22'. This provides the same first axis 1 immovable relative to cover 34, second axis 2 movable relative to cover 34 and third axis 3 movable between an unlocked position on one side of an imaginary line running through axes 1 and 2 and a locked position on the other side of the imaginary line.

The first locking member portion in the present embodiment takes the form of a pivotably mounted locking member 27 (see FIGS. 20, 21) centrally disposed at the front end of socket 10' and pivotably mounted at 12*c*' of base 12' (FIG. 19) and formed with a force receiving release surface 27*b* and a locking pin catch 27*a*. In addition to socket locking pin 24*f*, second locking link 24' is also provided with a system locking and release pin 24*g* spaced a selected distance from socket locking pin 24*f*. Second link 24' is also provided with a follower surface 24*h* which cooperates with a cam surface 22*g* of first link 22'. In this embodiment, third axis 3 is maintained stable by system locking and release pin 24*g* tightly biased against cover 34.

Figure 22A:
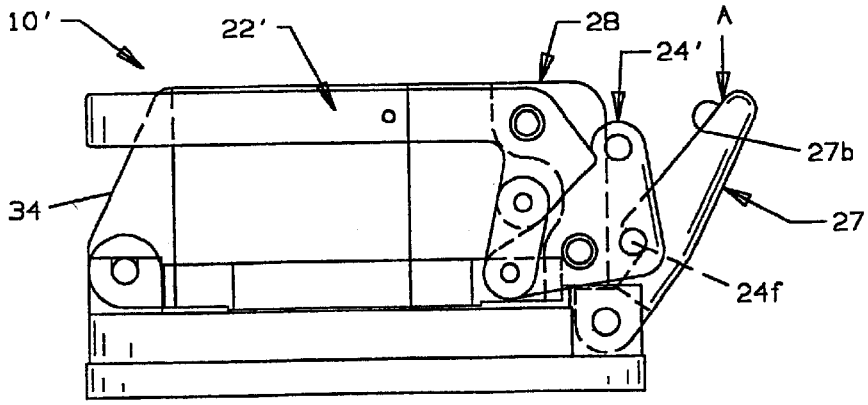
FIGS. 22*a*–22*c* show intermediate positions of the FIGS. 20, 21 socket being released (opened) by an automatic mechanism, not shown.
Figure 22B:
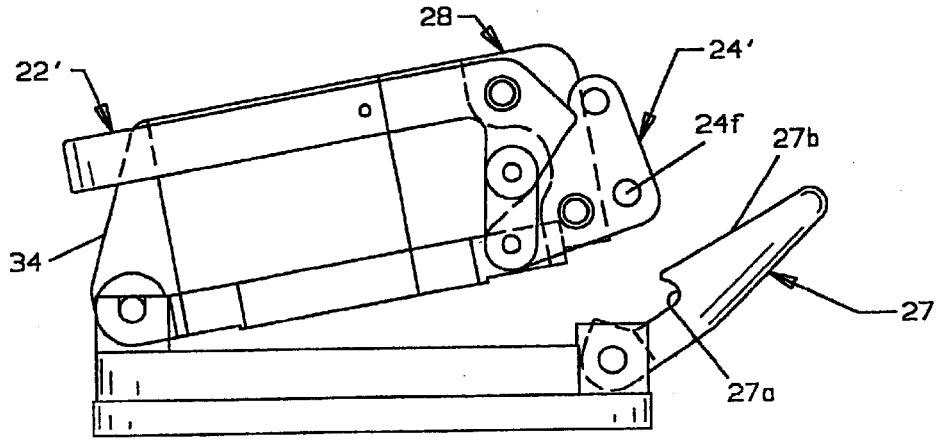
Figure 22C:
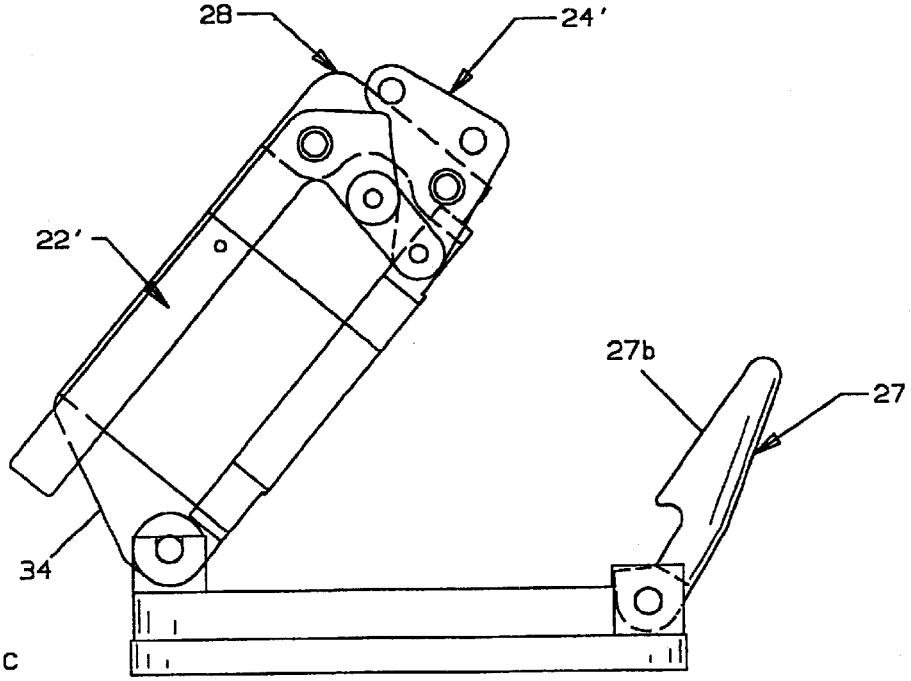

With reference to FIGS. 22*a*–22*c*, an automated release is effected by applying a force on release surface 27*b* by a suitable mechanism, not shown, but indicated by arrow A in FIG. 22*a*. Locking member 27 is pivoted away from cover 34 thereby moving locking pin catch 27*a* away from locking pin 24*f* allowing cover 34 to pivot to the opened position shown in FIG. 22*c* under the influence of suitable spring members, not shown.

Figure 23A:
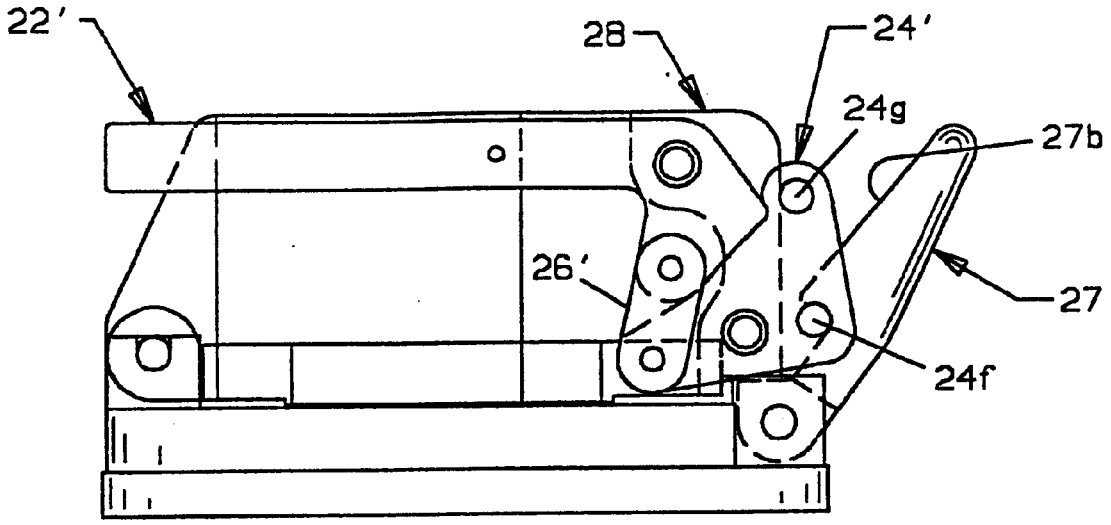
FIGS. 23*a*–23*d* show intermediate positions of the FIGS. 20, 21 socket being released (opened) manually.
Figure 23B:
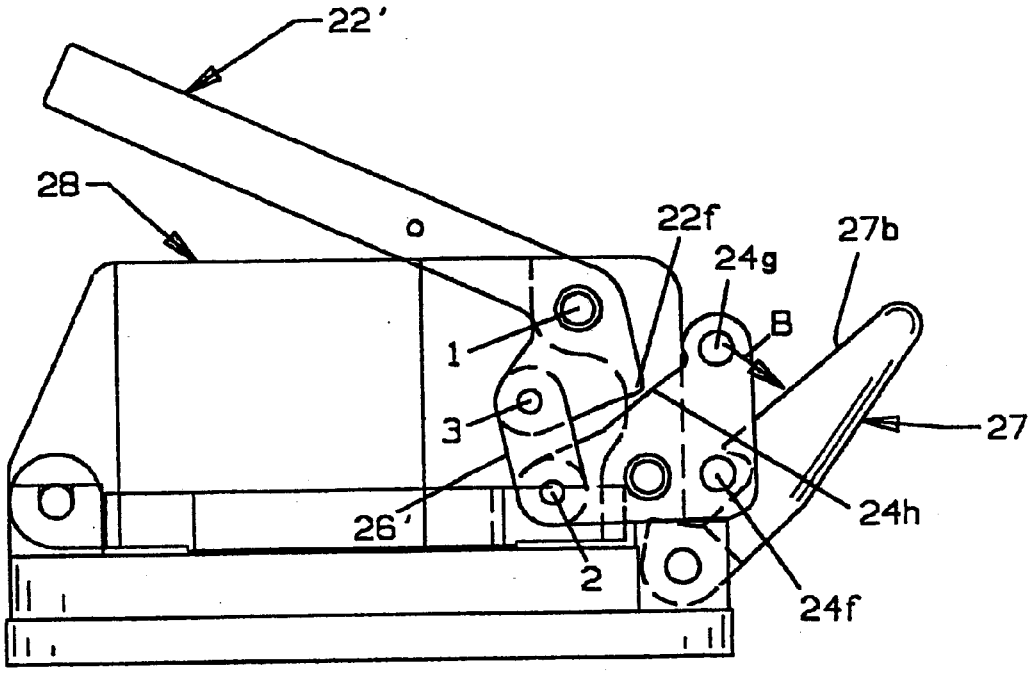
Figure 23C:
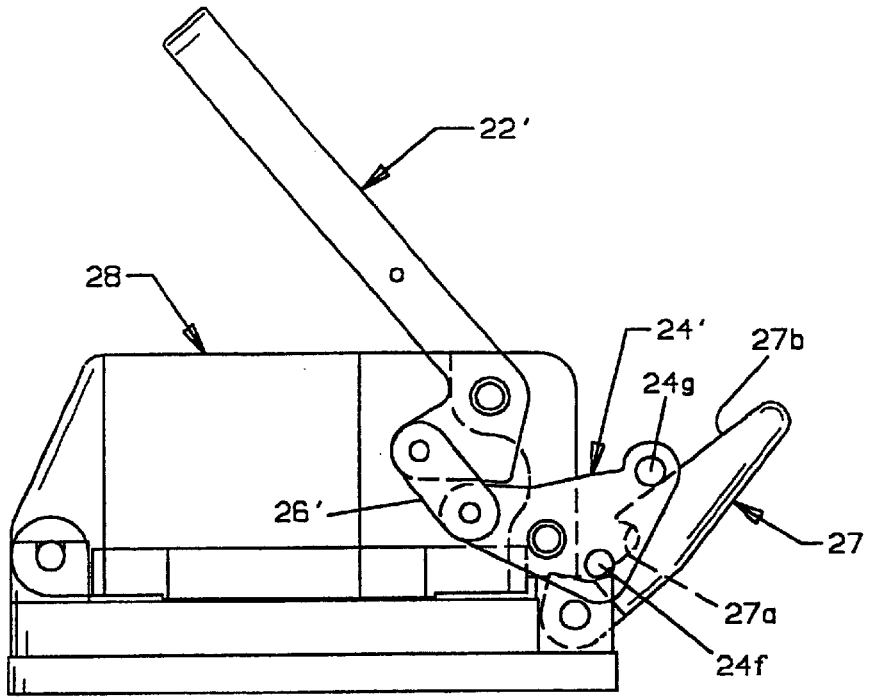
Figure 23D:
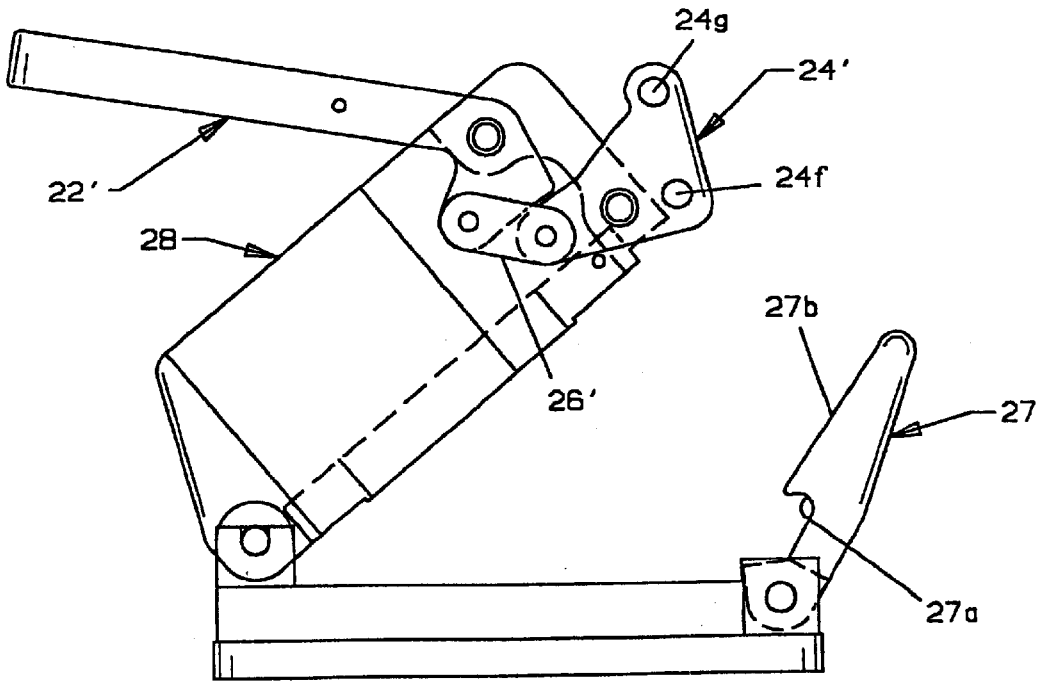

FIGS. 23*a*–23*d* show intermediate steps in manually opening of cover 34. FIG. 23*a* reflects the locked position while FIG. 23*b* shows first handle link 22' pivoted causing cam surface 22*f* to rotate second locking link 24' moving axis 3 to the unlocked position and bringing release pin 24*g* into engagement with release surface 27*b* of locking member 27 (FIG. 23*c*) indicated by arrow B in FIG. 23*b* causing it to pivot moving locking pin catch 27*a* away from locking pin 24*f* (FIG. 23*c*) to allow cover 34 to pivot to the open position shown in FIG. 23*d*.

In this embodiment, over-center motion of axis 3 (FIG. 21) is limited by engagement of follower surface 24*h* with first handle link 22' as shown in FIG. 21.

Figure 24:
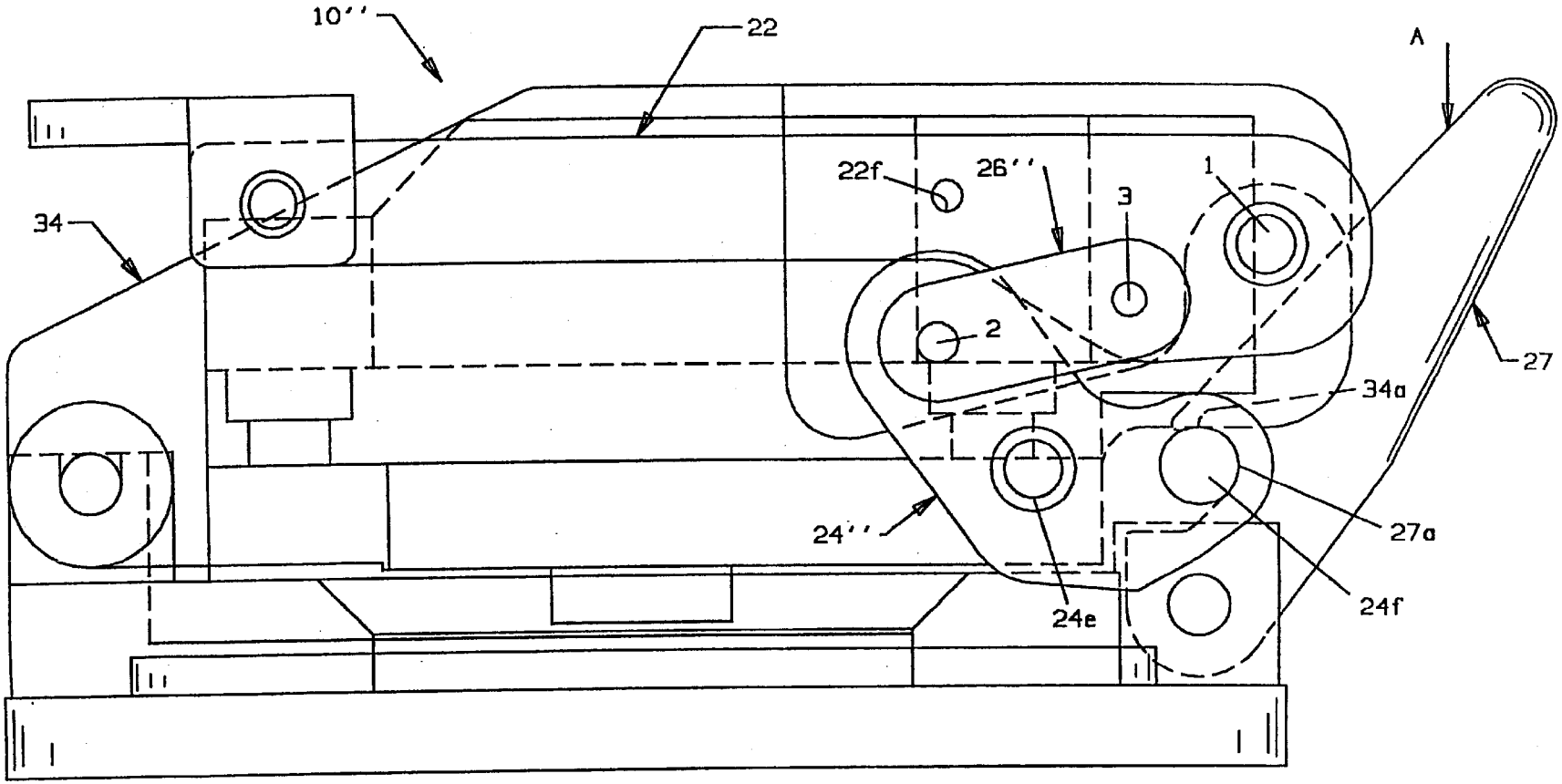
FIG. 24 is a side elevational view of a modification of the FIGS. 20, 21 embodiment.

FIG. 24 shows a modification 10 of the FIGS. 20, 21 embodiment in which the socket locking pin 24*f*, extending between the respective second or locking links 24" at each side of the socket, serves both to inter-engage with catch 27*a* to hold the cover in the closed position when the linking mechanism is locked as well as to interact with cover 34 at surface 34*a* for locking the mechanism. The locking and stabilizing function performed by system locking and release pin 24*g* biased against cover 34 in the FIGS. 20, 21 embodiment and by surface 14*g* of cover 14 biased against surface 12*g* of locking bar 12*e* of the FIGS. 1–9 embodiment is performed in the FIG. 24 embodiment by pin 24*f* tightly biased against surface 34*a* of cover 34.

In the FIG. 24 embodiment, starting at the closed, locked socket position, as the handle link 22 is pivoted away from the cover once axis 3 moves to the opposite side of the imaginary line between axes 1 and 2. Rotation of links 26" and 24" cause pin 24*f* to move downwardly and inwardly toward the center of the socket resulting in separation of the pin and locking catch 27*a* for manual release. As in the FIGS. 20, 21 embodiment, a downward force on locking member 27 as indicated by arrow A, will rotate locking member 27 downwardly resulting in separation in the automated mode of operation.

It should be understood that the invention includes all modifications and equivalents of the described embodiments falling within the scope of the appended claims.

What is claimed:

1. A socket for removably receiving an electronic part having a plurality of contacts disposed along a bottom surface thereof comprising:

a contact member mounting plate, a plurality of contact members mounted in the contact member mounting plate for providing electrical interconnection between contacts of the electronic part and a circuit board, a base member having an electronic part seating aperture mounted on the contact member mounting plate, a cover having first and second opposite ends, the first end pivotably mounted on the base member for movement of the cover between opened and closed positions and having at least one spring member urging the cover toward the opened position, the cover having a centrally located heat sink member receiving aperture therethrough, a heat sink member mounted for movement relative to the cover, the heat sink member having a portion extending through the heat sink member receiving aperture in the cover in a first direction for engagement with the electronic part disposed in the electronic part seating aperture, said portion of the heat sink member extending through the heat sink member aperture being formed with a generally flat engagement surface for engagement with a die portion of the electronic part having a selected outer peripheral configuration, the engagement surface formed with a recessed area containing the peripheral configuration of the die portion so that physical contact of the engagement surface with the die portion will be inboard of the outer periphery thereof, and a locking mechanism for locking the cover in the closed position.

2. A socket according to claim 1 in which the heat sink has a boss centrally located on the portion extending through the heat sink member receiving aperture and formed with a generally flat electronic part engagement surface so that the engagement surface can move into engagement with a selected portion of the electronic part having a selected height.

3. A socket according to claim 1 further including at least one spring member mounted on the socket to urge the portion of the heat sink member in the first direction through the heat sink member receiving aperture of the cover.

4. A socket according to claim 1 in which a bore is formed in the heat sink member and further comprising an elongated member having two opposite ends, the elongated member extending through the bore with one end attached to the cover and the other end having a head, a spring received between the heat sink member and the head to urge the heat sink portion in the first direction through the heat sink member receiving aperture of the cover.

5. A socket according claim 1 including three spring members mounted on the cover, two spring members disposed near the second end of the cover and one spring member disposed near the first end of the cover to urge the heat sink portion in the first direction through the heat sink member receiving aperture of the cover.

6. A socket according to claim 1 in which the cover has a bottom surface which faces the contact mounting plate when the cover is in the closed position and further comprising at least one pressure bar mounted on the cover to extend in the first direction beyond the bottom surface.

7. A socket according to claim 6 further comprising first and second pressure bars mounted on the cover to extend in the first direction beyond the bottom surface, one pressure bar on each of two opposite sides of the heat sink receiving aperture.

8. A socket according to claim 7 in which the pressure bars are movable relative to the cover and a flexible member is disposed between the cover and each pressure bar.

9. A socket according to claim 8 in which each flexible member is recessed from the bottom surface of the cover.

10. A socket for removably receiving an electronic part having a plurality of contacts disposed along a bottom surface thereof comprising:

a contact member mounting plate, a plurality of contact members mounted in the contact member mounting plate for providing electrical interconnection between contacts of the electronic part and a circuit board, a base member having an electronic part seating aperture mounted on the contact member mounting plate, a cover having first and second opposite ends, the first end pivotably mounted on the base member for movement of the cover between opened and closed positions and having at least one spring member urging the cover toward the opened position, the cover having a centrally located heat sink member receiving aperture therethrough, a heat sink member mounted for movement relative to the cover, the heat sink member having a portion extending through the heat sink member receiving aperture in the cover in a first direction for engagement with the electronic part disposed in the electronic part seating aperture, said cover having three spring members mounted thereon, two spring members disposed near the second end of the cover and one spring member disposed near the first end of the cover to urge the heat sink portion in the first direction through the heat sink member receiving aperture of the cover, and a locking mechanism for locking the cover in the closed position.

11. A socket according to claim 10 in which the heat sink has a boss centrally located on the portion extending through the heat sink member receiving aperture and formed with a generally flat electronic part engagement surface so that the engagement surface can move into engagement with a selected portion of the electronic part having a selected height.

12. A socket according to claim 10 further including at least one spring member mounted on the socket to urge the portion of the heat sink in the first direction through the heat sink member receiving aperture of the cover.

13. A socket according to claim 10 in which a bore is formed in the heat sink member and further comprising an elongated member having two opposite ends, the elongated member extending through the bore with one end attached to the cover and the other end having a head, a spring received between the heat sink member and the head to urge the heat sink portion in the first direction through the heat sink member receiving aperture of the cover.

14. A socket according to claim 10 in which the cover has a bottom surface which faces the contact mounting plate when the cover is in the closed position and further comprising at least one pressure bar mounted on the cover to extend in the first direction beyond the bottom surface.

15. A socket according to claim 14 further comprising first and second pressure bars mounted on the cover to extend in the first direction beyond the bottom surface, one pressure bar on each of two opposite sides of the heat sink receiving aperture.

16. A socket according to claim 15 in which the pressure bars are movable relative to the cover and a flexible member is disposed between the cover and each pressure bar.

17. A socket according to claim 16 in which each flexible member is recessed from the bottom surface of the cover.

* * * * *